US008029626B2

(12) United States Patent
Ishihara et al.

(10) Patent No.: US 8,029,626 B2
(45) Date of Patent: Oct. 4, 2011

(54) METHOD FOR PRODUCING SOFT MAGNETIC POWDERED CORE

(75) Inventors: Chio Ishihara, Matsudo (JP); Kazuo Asaka, Matsudo (JP); Kohei Muramatsu, Matsudo (JP); Tsuyoshi Akao, Kariya (JP); Hirotake Hamamatsu, Kariya (JP)

(73) Assignees: Hitachi Powered Metals Co., Ltd., Matsudo (JP); Denso Corporation, Kariya (JP)

( * ) Notice: Subject to any disclaimer, the term of this patent is extended or adjusted under 35 U.S.C. 154(b) by 664 days.

(21) Appl. No.: 12/076,336

(22) Filed: Mar. 17, 2008

(65) Prior Publication Data

US 2008/0230737 A1 Sep. 25, 2008

(30) Foreign Application Priority Data

Mar. 19, 2007 (JP) ..... 2007-070712

(51) Int. Cl.
*H01F 1/24* (2006.01)

(52) U.S. Cl. ..... 148/104; 252/62.54; 148/121

(58) Field of Classification Search ..... None
See application file for complete search history.

(56) References Cited

U.S. PATENT DOCUMENTS

| | | | | |
|---|---|---|---|---|
| 6,054,219 | A | 4/2000 | Satsu et al. | |
| 6,344,273 | B1 | 2/2002 | Satsu et al. | |
| 7,211,158 | B2 | 5/2007 | Ishihara et al. | |
| 7,273,527 | B2 | 9/2007 | Ishihara et al. | |
| 2003/0062660 | A1 * | 4/2003 | Beard et al. | 264/645 |

FOREIGN PATENT DOCUMENTS

| | | | |
|---|---|---|---|
| DE | 102 07 133 | A1 | 9/2002 |
| EP | 0 437 851 | A2 | 7/1991 |
| JP | A-60-235412 | | 11/1985 |
| JP | A-09-320830 | | 12/1997 |
| JP | A-2002-246219 | | 8/2002 |
| JP | A-2004-146804 | | 5/2004 |

* cited by examiner

*Primary Examiner* — John Sheehan
(74) *Attorney, Agent, or Firm* — Oliff & Berridge, PLC

(57) ABSTRACT

A method for producing a soft magnetic powdered core comprises a mixing step for forming a raw powder by adding a thermoplastic resin powder to a soft magnetic powder and mixing them, a compacting step for forming a compact by compacting the raw powder into a predetermined shape, a melting and setting step for the resin in which the resin of the compact is melted by heating to at least the melting point of the thermoplastic resin and the melted resin is set by cooling to a room temperature, and a crystallizing step for the resin in which the set resin is heated to not less than the exothermic onset temperature and not more than the endothermic onset temperature, which are measured by DSC analysis of the thermoplastic resin, and is cooled to a room temperature.

4 Claims, 2 Drawing Sheets

A:Exothermic onset temperature
B:Exothermic peak temperature
C:Exothermic end temperature
D:Endothermic (melting) onset temperature

METHOD FOR PRODUCING SOFT MAGNETIC POWDERED CORE

BACKGROUND OF THE INVENTION

1. Technical Field

The present invention relates to a method for producing a soft magnetic powdered core, which is preferably used for electric transformers, reactors, thyristor valves, noise filters, choke coils, and the like, and is more preferably used for soft magnetic motor cores, rotors and yokes of motors in home appliances and industrial instruments, solenoid cores (stator cores) for solenoid valves installed in an electronically controlled fuel injector for a diesel engine or a gasoline engine, and the like, which require high magnetic flux density.

2. Background Art

Iron loss is a very important characteristic of soft magnetic cores and is defined by eddy current loss relating to a specific electric resistivity value of a magnetic core and hysteresis loss affected by strain in a soft magnetic powder, which is generated in a production process of the soft magnetic powder and subsequent processing steps. The iron loss W can be specifically defined by the sum of eddy current loss $W_e$ and hysteresis loss $W_h$ as shown in the following formula (1). The eddy current loss $W_e$ and the hysteresis loss $W_h$ can be defined by the following formulas (2) and (3), respectively. In this case, "f" represents the frequency, "$B_m$" represents the exciting magnetic flux density, "ρ" represents the specific electric resistivity value, "t" represents the thickness of a material, and "$k_1$" and "$k_2$" represent coefficients.

$$W=W_e+W_h \quad (1)$$

$$W_e=(k_1B_m^2t^2/\rho)f^2 \quad (2)$$

$$W_h=k_2B_m^{1.6}f \quad (3)$$

As is clear from the formulas (1) to (3), while the hysteresis loss $W_h$ is proportional to the frequency f, the eddy current loss $W_e$ is proportional to the square of the frequency f. Therefore, decrease of the eddy current loss $W_e$ is effective in decreasing the iron loss W, specifically in a high frequency area. In order to decrease the eddy current loss $W_e$, the specific electric resistivity value ρ should be increased by limiting the eddy current loss in a small area.

A soft magnetic powdered core is formed by interposing nonmagnetic resin between soft magnetic powder particles such as iron powders so as to limit eddy current loss to each soft magnetic powder particle. The soft magnetic powdered core has high specific electric resistivity value ρ and small eddy current loss $W_e$, and it can be produced by simple methods, whereby it is conventionally widely used (for example, see Japanese Patent Application of Laid-Open No. 60-235412). In the soft magnetic powdered core disclosed in the above Japanese Patent Application of Laid-Open No. 60-235412, resin exists between soft magnetic powder particles, whereby electrical insulation between the soft magnetic powder particles is specifically ensured. As a result, the eddy current loss $W_e$ is decreased, and the soft magnetic powders are tightly bound, whereby strength of the soft magnetic powdered core is improved.

On the other hand, in a soft magnetic powdered core, nonmagnetic resin exists between soft magnetic powder particles, whereby amount of the soft magnetic powder (space factor) decreases according to the amount of resin contained in the magnetic core. Therefore, the soft magnetic powdered core has a disadvantage in that the magnetic flux density may be decreased. In order to overcome this disadvantage, a technique is disclosed in Japanese Patent Application of Laid-Open No. 9-320830 in which electrical insulation of a soft magnetic powder is improved by forming an insulating film on surfaces of the soft magnetic powder particles so as to decrease additive amount of resin, and this technique is used in practice. Moreover, further improvement in the magnetic properties is required recently, and in response to this requirement, a soft magnetic powdered core is disclosed in Japanese Patent Application of Laid-Open No. 2004-146804 in which additive amount of resin is further decreased.

As described above, the additive amount of resin in a soft magnetic powdered core is required to be small from the viewpoint of the magnetic properties. However, the soft magnetic powdered core has a structure in which the resin binds the soft magnetic powder particles, and the reduction of the additive amount of resin thereby causes a decrease in strength of the soft magnetic powdered core. The soft magnetic powdered core was not used for a member that requires strength, and the decrease in the strength was not a serious problem. On the other hand, recently, a portion is required to have a highly precise and complex shape, and a soft magnetic powdered core should be machined. Under such circumstances, it is difficult to machine a soft magnetic powdered core in which the additive amount of resin is further decreased, because strength thereof is not sufficient. A soft magnetic powdered core may be used in combination as various actuators, or it may be molded in resin, and therefore, external force is often applied thereto. Moreover, chipping easily occurs when soft magnetic powdered cores strike each other during a process such as when they are being conveyed, and the soft magnetic powdered core requires extra attention during assembling and when being transported. In order to prevent chipping of the soft magnetic powdered core, increase in the binding power of the soft magnetic powdered core is required.

SUMMARY OF THE INVENTION

The present invention has been completed in order to improve the above-mentioned circumstances. An object of the present invention is to provide a method for producing a soft magnetic powdered core in which strength and binding power are improved but magnetic properties are not deteriorated, that is, the additive amount of resin is not different from that of conventional power magnetic cores.

According to the first aspect of the invention, the present invention provides a method for producing a soft magnetic powdered core comprising a mixing step for forming a raw powder by adding a thermoplastic resin powder to a soft magnetic powder and mixing them, a compacting step for forming a compact by compacting the raw powder into a predetermined shape, a melting and setting step for a resin in which the resin of the compact is melted by heating to at least the melting point of the thermoplastic resin and the melted resin is set by cooling it to a room temperature, and a crystallizing step for the resin in which the set resin is heated to not less than the exothermic onset temperature and not more than the endothermic onset temperature, which are, measured by DSC analysis (Differential Scanning Calorimetry) of the thermoplastic resin, and it is cooled to a room temperature.

Moreover, according to the second aspect of the invention, the present invention provides a method for producing a soft magnetic powdered core in which the melting and setting step for the resin and the crystallizing step for the resin in the above method for producing a soft magnetic powdered core according to the first aspect of the present invention are performed in one process. The method for producing a soft magnetic powdered core according to the second aspect of the present invention comprises a mixing step for forming a raw powder by adding a thermoplastic resin powder to a soft magnetic powder and mixing them, a compacting step for forming a compact by compacting the raw powder into a predetermined shape, and a melting and setting step for the resin in which the compact is heated to at least the melting point of the thermoplastic resin so as to melt the resin thereof, and it is maintained in a temperature range of not more than the exothermic onset temperature and not less than the exothermic end temperature, which are measured by DSC analysis of the thermoplastic resin, while it is cooled to a room temperature.

Furthermore, according to the third aspect of the present invention, the present invention provides a method for producing a soft magnetic powdered core in which the melting and setting step for the resin in the above method for producing a soft magnetic powdered core according to the first aspect of the present invention is not performed, whereas the crystallizing step is performed. The method for producing a soft magnetic powdered core according to the third aspect of the present invention comprises a mixing step for forming a raw powder by adding a thermoplastic resin powder to a soft magnetic powder and mixing them, a compacting step for forming a compact by compacting the raw powder into a predetermined shape, and a crystallizing step for the resin in which the compact is heated to not less than the exothermic onset temperature and not more than the endothermic onset temperature, which are measured by DSC analysis of the thermoplastic resin, and it is cooled to a room temperature.

A soft magnetic powdered core is obtained by the production method of the present invention comprising mixing a thermoplastic resin powder with a soft magnetic powder so as to obtain a raw powder, compacting the raw powder into a predetermined shape so as to obtain a compact, heating the compact to at least the melting point of the thermoplastic resin so as to obtain a soft magnetic powdered core, and reheating the soft magnetic powdered core to not less than the exothermic onset temperature and not more than the endothermic onset temperature of the thermoplastic resin. Therefore, the thermoplastic resin is crystallized by reheating, whereby strength and binding power of the soft magnetic powdered core are improved. Accordingly, a soft magnetic powdered core having sufficient strength for machining and having chipping-resistance to chipping can be obtained.

BRIEF DESCRIPTION OF DRAWINGS

FIG. 2A is a photograph of the appearance of an example of the present invention for which a crystallizing step for the resin was performed, and FIG. 2B is a photograph of the appearance of a conventional example for which the crystallizing step for the resin was not performed.

PREFERRED EMBODIMENTS OF INVENTION

Figure 1A:
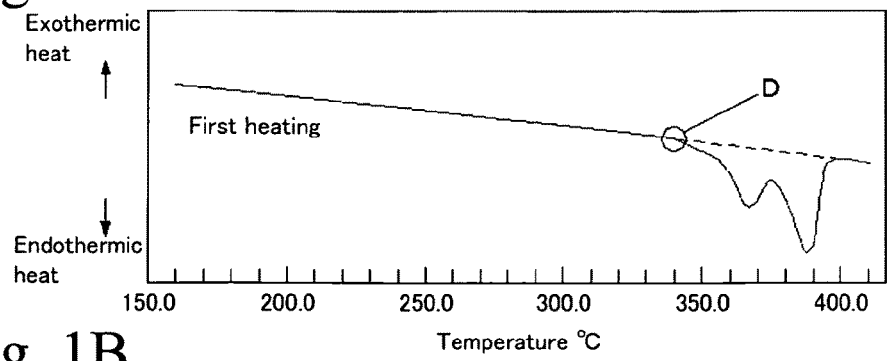
FIGS. 1A to 1C are graphs showing results of DSC analysis of a thermoplastic resin.
Figure 1B:
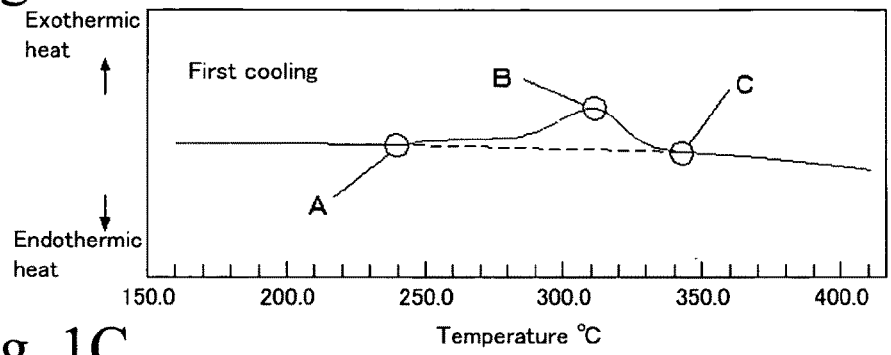
Figure 1C:
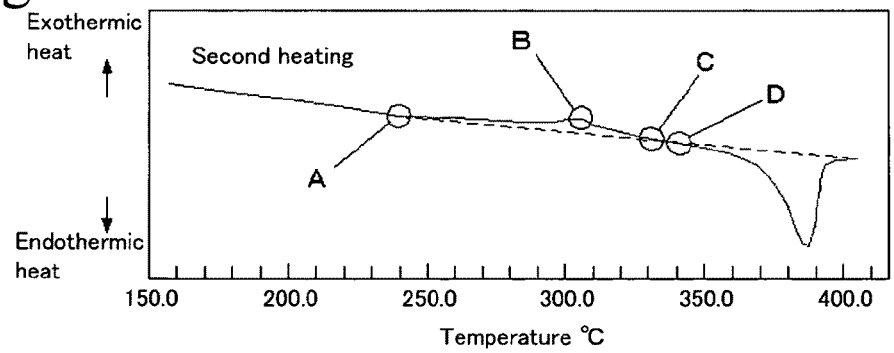

FIGS. 1A to 1C are graphs showing results of DSC analysis of a thermoplastic resin (thermoplastic polyimide), which was performed at heating rate of 10° C./min and cooling rate of 10° C./min. FIG. 1A shows a graph of first heating, FIG. 1B shows a graph of first cooling, and FIG. 1C shows a graph of second heating.

As shown in FIG. 1A, during the first heating, an exothermic reaction is not observed, and an endothermic reaction occurs at around 340° C. when a thermoplastic resin starts to melt. The endothermic reaction has two peaks at around 367° C. and 387° C. When the thermoplastic resin melted in such a way is cooled, as shown in FIG. 1B, an exothermic reaction starts at around 345° C., and the thermoplastic resin is crystallized.

When a thermoplastic resin exhibiting such thermal reactions is reheated, as shown in FIG. 1C, an exothermic reaction occurs in a temperature range of approximately 240° C. to 330° C., which did not occur during the first heating. After the exothermic reaction, an endothermic reaction starts at approximately 340° C., and the thermoplastic resin is remelted. The second melting has one peak at around 386° C., and two peaks that were observed during the first heating were not observed. The exothermic reaction of the second heating may have occurred due to crystallizing of portions that were not crystallized during cooling after the first heating. That is, as shown in FIGS. 1A to 1C, in a soft magnetic powdered core containing a thermoplastic resin, the thermoplastic resin may be insufficiently crystallized. In this case, even when the thermoplastic resin in a soft magnetic powdered core is insufficiently crystallized, the thermoplastic resin can be completely crystallized by reheating, whereby strength of the thermoplastic resin may be improved, and strength of the soft magnetic powdered core may be improved.

The inventors have intensively researched these respects and found following facts. An actual cooling rate of a soft magnetic powdered core is set according to a range of crystallization temperature in the thermoplastic resin to be used, and it is set to be the same or higher than 10° C./min, which is the cooling rate used in the above-described DSC analysis. Therefore, uncrystallized portions remain in the thermoplastic resin of the soft magnetic powdered core. Moreover, the inventors found that strength and binding power of the soft magnetic powdered core can be improved by crystallizing all of the uncrystallized portions.

The present invention has been completed by using these findings, and a method for producing a soft magnetic powdered core according to the first aspect of the present invention has an essential feature that a soft magnetic powdered core including uncrystallized portions in a thermoplastic resin is reheated so as to crystallize all of the uncrystallized portions in the thermoplastic resin. The method for producing a soft magnetic powdered core according to the second aspect of the present invention has an essential feature that a thermoplastic resin is sufficiently crystallized by maintaining it in a range of crystallization temperature thereof during cooling, in order not to produce uncrystallized portions in the thermoplastic resin of a soft magnetic powdered core.

In the method for producing a soft magnetic powdered core according to the first aspect of the present invention, in order to crystallize uncrystallized portions in thermoplastic resin, the thermoplastic resin should be heated to not less than the exothermic onset temperature thereof during a crystallizing step for the resin. On the other hand, since the crystallized thermoplastic resin is remelted, if the thermoplastic resin is heated to more than the endothermic (melting) onset temperature thereof, the upper limit of the heating temperature should be not more than the endothermic onset temperature thereof. The results of further research on the temperature range will be described with reference to FIGS. 1A to 1C. Temperature between the exothermic onset temperature (point A) and the endothermic onset temperature (point D) changes through an exothermic peak temperature (point B) and an exothermic end temperature (point C). Strength of a soft magnetic powdered core increases and is improved according to temperature increase until the exothermic peak temperature (point B), whereas it slightly decreases when the temperature exceeds the exothermic peak temperature (point B). When binding power is represented by a rattler value, the rattler value decreases and is improved according to temperature increase until the exothermic peak temperature (point B), and then it exhibits a constant value until the temperature reaches the endothermic onset temperature (point D). Therefore, considering the decrease in the strength, the upper limit of the heating temperature during the crystallizing step for the resin is preferably set to the exothermic end temperature (point C). In order to primarily improve strength, the temperature range is preferably set to not less than the exothermic onset temperature (point A) and not more than the exothermic peak temperature (point B) of thermoplastic resin. In order to primarily improve the rattler value, the temperature range is preferably set to not less than the exothermic peak temperature (point B) and not more than the exothermic end temperature (point C) of thermoplastic resin. In addition, the temperature is more preferably in the vicinity of the exothermic peak temperature (point B) because the strength and the rattler value are most improved. In view of temperature variation in a heating furnace, it is the most preferable that the temperature be set to +10° C. of the exothermic peak temperature (point B). When the heating is performed in this temperature range, the magnetic properties are not affected, and the strength and the binding power of a soft magnetic powdered core can be improved, whereas the magnetic properties are not deteriorated, specifically, the iron loss is not increased.

The heating temperature should be maintained within the above range until the thermoplastic resin is completely crystallized during the crystallizing step for the resin. The maintaining time depends on the amount of uncrystallized portions contained in the thermoplastic resin of a soft magnetic powdered core after the melting and setting step for the resin. That is, the maintaining time depends on the cooling rate in the melting and setting step for the resin. In a case of using a heating furnace in which the cooling rate (cooling rate at a temperature range from the exothermic onset temperature to the exothermic end temperature of thermoplastic resin) during the melting and setting step for a resin is typical (cooling rate: 1 to 10° C./min), the maintaining time is preferably set to approximately 10 minutes to 3 hours.

As a soft magnetic powder used for a soft magnetic powdered core, a soft magnetic powder coated with an insulating film on the surface, which is, for example, disclosed in Japanese Patent Application of Laid-Open No. 9-320830, is preferably used because the eddy current is limited within the soft magnetic powder particles, and the eddy current loss and the iron loss are thereby decreased. In this case, the insulating film is made of an oxide type (a phosphate type as used in Japanese Patent Application of Laid-Open No. 9-320830). Therefore, when a reducing gas atmosphere is used in a melting and setting step and a crystallizing step for the resin, the insulating film is reduced and is decomposed, whereby the specific electric resistivity value is extremely decreased and the iron loss is suddenly increased. Accordingly, a nitrogen gas atmosphere or an inert gas atmosphere should be used so as to avoid such a reduction reaction. The inventors found that a nitrogen gas atmosphere or an inert gas atmosphere may be used in the crystallizing step for the resin, but the strength and the binding power (rattler value) of the soft magnetic powdered core are further improved when an air atmosphere is used. This is because impurity components, which are included in a thermoplastic resin and will not be crystallized, are evaporated by heating, and they are eliminated from the thermoplastic resin when an air atmosphere is used in a crystallizing step for the resin for crystallizing uncrystallized portions of the thermoplastic resin. Therefore, strength and binding power (rattler value) of the resin are improved after the crystallization. Accordingly, when a powder coated with an insulating film on the surface is used as a soft magnetic powder for a soft magnetic powdered core, a nitrogen gas atmosphere or an inert gas atmosphere is preferably used in a melting and setting step for the resin, and an air atmosphere is preferably used in a crystallizing step for the resin.

In the above method for producing a soft magnetic powdered core according to the first aspect of the present invention, heat treatment after compaction molding is designed for a case in which uncrystallized portions remain in a thermoplastic resin. The heat treatment after compaction molding may be performed so as to completely crystallize the thermoplastic resin, and a recrystallizing step for the resin can be omitted. This procedure is the essential feature of a method for producing a soft magnetic powdered core according to the second aspect of the present invention. This method is also designed for the same purpose as that in the above case of crystallization step for a thermoplastic resin. That is, after the thermoplastic resin is melted and is penetrated between soft magnetic powder particles, it is maintained in a temperature range of not more than the exothermic onset temperature and not less than the exothermic end temperature thereof so that it will be completely crystallized as it is cooled to a room temperature. As a result, strength and binding power of the soft magnetic powdered core are improved. In this case, it is most effective for crystallizing the thermoplastic resin that the thermoplastic resin be maintained in the vicinity of the exothermic peak temperature, and it is most preferable that the temperature range be set to approximately ±10° C. of the exothermic peak temperature. The temperature should be maintained until the thermoplastic resin is completely crystallized, and specifically, the maintaining time is preferably set to 10 minutes to 3 hours.

In the method for producing a soft magnetic powdered core according to the second aspect of the present invention, a powder coated with an insulating film on the surface is also preferably used as a soft magnetic powder, and the above-described atmosphere gas can also be used. That is, a reducing atmosphere should not be used during the melting and setting step for the resin, and a nitrogen gas atmosphere or an inert gas atmosphere is suitable for the heat treatment. The nitrogen gas atmosphere or the inert gas atmosphere may be used during cooling. Moreover, it is preferable that a thermoplastic resin be maintained at not more than the exothermic onset temperature thereof and be cooled in an air atmosphere because strength and binding power are improved due to the above-described reason.

High strength can be obtained by the above methods for producing a soft magnetic powdered core according to the first aspect and the second aspect of the present invention. The inventors have further researched and found that strength higher than that of a conventional soft magnetic powdered core which is yielded by a melting and setting step can be obtained by performing the above crystallizing step for the resin after the compacting step without performing the melting and setting step for the resin for melting thermoplastic resin. This is because a commercially available thermoplastic resin powder may not be sufficiently crystallized, and numerous uncrystallized portions may exist. According to this finding, strength can be improved only by crystallizing the uncrystallized portions contained in a commercially available thermoplastic resin powder in large quantities. The strength can be higher than that of a conventional soft magnetic powdered core formed by melting thermoplastic resin but still containing numerous uncrystallized portions in the thermoplastic resin. Therefore, the melting and setting step can be omitted, whereby production cost can be decreased. Accordingly, a step can be selected according to strength and cost that are necessary. The above methods for producing a soft magnetic powdered core according to the first aspect and the second aspect of the present invention may be used when high strength is required, and the method for producing a soft magnetic powdered core according to the third aspect of the present invention may be used when a low cost is most required, and strength is required to be at least higher than that of a conventional soft magnetic powdered core.

In the method for producing a soft magnetic powdered core according to the third aspect of the present invention, a powder coated with an insulating film on the surface is preferably used as a soft magnetic powder, and the above-described atmosphere gas is also preferably used in a crystallizing process. That is, nitrogen gas or inert gas may be used as the atmosphere gas. Moreover, it is preferable that the thermoplastic resin be maintained at not more than the exothermic onset temperature thereof and be cooled in an air atmosphere because strength and binding power are improved due to the above-described reason.

The method for producing a soft magnetic powdered core of the present invention is effective in producing a conventional soft magnetic powdered core containing a large amount of resin. Moreover, strength and binding power of the thermoplastic resin are effectively improved when the present invention is used for producing recently developed power magnetic cores containing resin in small amounts. That is, since a conventional soft magnetic powdered core contains a large amount of resin, numerous crystallized portions exist and uncrystallized portions remain, whereby strength is not extremely decreased. On the other hand, in a recently developed soft magnetic powdered core containing resin in a small amount, the resin existing between soft magnetic powder particles is thin and is scarce. Therefore, strength may be extremely decreased when the resin in a small amount remains uncrystallized. From this point of view, the above step for completely crystallizing thermoplastic resin is specifically effective for a soft magnetic powdered core in which the thermoplastic resin powder has a median size of 50 μm or less and is added at 0.005 to 5 vol %.

In a method for producing a soft magnetic powdered core disclosed in Japanese Patent Application of Laid-Open No. 2004-146804, the additive amount of thermoplastic resin is 0.01 to 5 vol %. Alternatively, the additive amount can be decreased to 0.005 to 2 vol % by using a resin powder having a specific surface area of 1.0 $m^2/cm^3$ or more, and magnetic properties can be improved while amount of resin is decreased.

FIRST EXAMPLE

Electrically insulated iron powder was obtained by coating phosphate chemical altered insulating film on the surface of an iron powder. Thermoplastic polyimide powder (resin A) having a median size of 30 μm and a specific surface area of 2.0 $m^2/cm^3$ was added at 0.1 vol % to the electrically insulated iron powder, and they were mixed so as to prepare a raw powder. The raw powder was compacted at a compacting pressure of 1470 MPa to obtain a compact having a ring shape in which an inner diameter was 20 mm, an outer diameter was 30 mm, and a height was 5 mm. A melting and fixing step of the resin was performed by heating and maintaining the compact at 360° C. for 1 hour in a nitrogen gas atmosphere. Then, a crystallizing step for the resin was performed at a heating temperature shown in Table 1 for 120 minutes in an air atmosphere, and samples having sample numbers 01 to 10 were formed. In these samples, compressive strength, rattler value, iron loss, and magnetic flux density were measured, and the results are shown in Table 1. In this case, the compressive strength was measured according to the compressive strength test method according to Japanese Industrial Standard (JIS) Z2507. The rattler value was measured according to the rattler test method for a metal compact defined by standard 4-69 according to the Japan Society of Powder and Powder Metallurgy (JSPM). Magnetic flux density $B_{8000A/m}$(T) was measured at a magnetizing force of 8000 A/m as a direct-current magnetic property, and iron loss W was measured at a frequency of 5 kHz and an exciting magnetic flux density of 0.245 T as a alternating-current magnetic property.

TABLE 1

| | Crystallizing step for resin | | | Evaluation items | | | | |
|---|---|---|---|---|---|---|---|---|
| Sample No. | Heating temperature (° C.) | Maintaining time (min) | Atmosphere | Compressive strength (MPa) | Rattler value (%) | Iron loss $W_{0.245\ T/5\ kHz}$ (kW/$m^3$) | Magnetic flux density $B_{8000\ A/m}$ (T) | Notes |
| 01 | — | — | — | 476 | 0.53 | 3006 | 1.860 | Crystallizing step for the resin was not performed (conventional example) |
| 02 | 200 | 120 | Air | 478 | 0.54 | 3004 | 1.862 | |
| 03 | 240 | 120 | Air | 581 | 0.35 | 2996 | 1.862 | exothermic onset temperature |
| 04 | 300 | 120 | Air | 606 | 0.30 | 3000 | 1.866 | |
| 05 | 305 | 120 | Air | 607 | 0.29 | 2986 | 1.860 | exothermic peak temperature |
| 06 | 310 | 120 | Air | 606 | 0.29 | 2986 | 1.865 | |
| 07 | 315 | 120 | Air | 605 | 0.29 | 2980 | 1.865 | |
| 08 | 330 | 120 | Air | 591 | 0.29 | 2958 | 1.864 | exothermic end temperature |
| 09 | 340 | 120 | Air | 550 | 0.29 | 2948 | 1.873 | endothermic onset temperature |
| 10 | 400 | 120 | Air | 453 | 0.54 | 6600 | 1.610 | remelting |

As shown in Table 1, the sample having sample number 02 was heated at a heating temperature of less than the exothermic onset temperature (240° C.) during the crystallizing step for the resin, and it exhibits low compressive strength and rattler value similar to those of the sample having sample number 01 in which the crystallizing step for the resin was not performed. On the other hand, the sample having sample number 03 maintained at the exothermic onset temperature (240° C.) exhibited high compressive strength and low rattler value, and they were improved. When the heating temperature during the crystallizing step for the resin exceeded the exothermic onset temperature, the compressive strength increases and is improved until the heating temperature reaches the exothermic peak temperature (305° C.). When the heating temperature exceeds the exothermic peak temperature, the compressive strength slightly decreases. On the other hand, the rattler value decreases and is improved until the heating temperature reaches the exothermic peak temperature, and it exhibits an approximately constant value when the heating temperature exceeds the exothermic peak temperature. In the samples having sample numbers 01 to 09, the iron loss and the magnetic flux density are approximately constant, and the magnetic properties are not affected by the crystallizing step for the resin when the heating temperature is not more than the endothermic onset temperature. The sample having sample number 10 was heated to more than the endothermic onset temperature, and the thermoplastic resin was remelted. In this case, the compressive strength and the rattler value were deteriorated to a similar degree as those of the sample having sample number 01 in which the crystallizing step for the resin was not performed. Moreover, in the sample having sample number 10 in which the thermoplastic resin was remelted, the iron loss was suddenly increased, and the magnetic flux density was extremely decreased. This was because the insulating film coated on the surface of the iron powder was decomposed by the remelting of the thermoplastic resin in an air atmosphere, and thereby the iron loss was increased. Simultaneously, the surface of the iron powder was oxidized, and the space factor of iron in the soft magnetic powdered core was decreased, whereby the magnetic flux density was decreased.

Figure 2A:
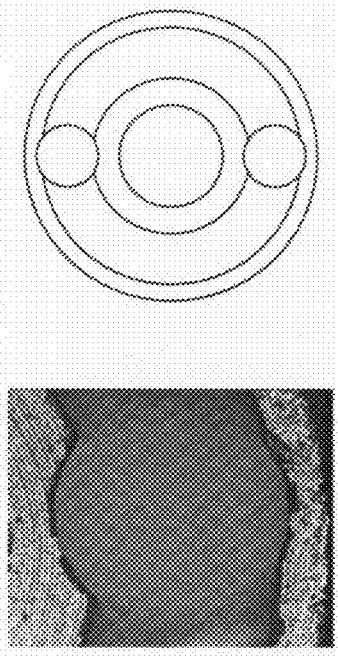
FIGS. 2A and 2B are photographs showing appearances of samples after a rattler test.
Figure 2B:
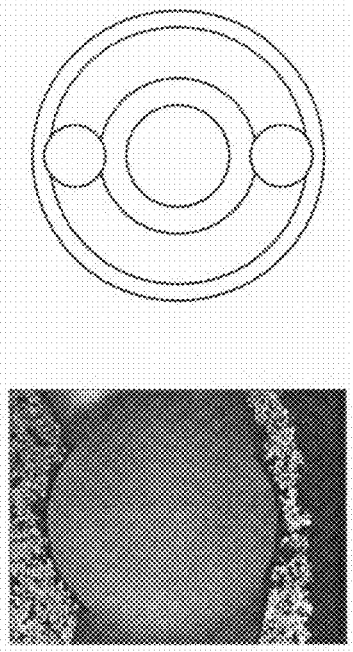

FIGS. 2A and 2B are photographs showing an appearance of each sample having sample number 01 or 07 after a rattler test. FIG. 2A is a photograph of the appearance of the sample having sample number 07 in which a crystallizing step for the resin was performed (example of the present invention), and FIG. 2B is a photograph of the appearance of the sample having sample number 01 in which a crystallizing step for the resin was not performed (conventional example). As shown by the photograph of the appearance in FIG. 2B, in the sample having sample number 01 in which the crystallizing step was not performed, the edge portions are chipped, and iron powder particles have fallen out from the surface of the sample. This appearance corresponds to the above test results in which the strength and the rattler value of the soft magnetic powdered core are inferior. On the other hand, as shown by the photograph of the appearance in FIG. 2A, in the sample having sample number 07 in which the crystallizing step for the resin was performed, the edge portions were not chipped, and the iron powder particles did not fall out from the surface of the sample after the rattler test. The sample having sample number 07 exhibits a good condition, similar to the condition thereof before the test. This result shows that the strength and the binding power can be sufficiently improved by the crystallizing step for the resin, and the above degree of improvement is sufficient for practical use.

As described above, by adding a second heating step that is performed in a temperature range of not less than the exothermic onset temperature and not more than the endothermic onset temperature of thermoplastic resin, the strength (compressive strength) and the binding power (rattler value) can be improved, and the magnetic properties of the soft magnetic powdered core are not deteriorated. The strength (compressive strength) and the binding power (rattler value) are further improved by performing a heat treatment at the exothermic peak temperature of thermoplastic resin. Therefore, the crystallizing step for the resin is preferably performed in the vicinity of the exothermic peak temperature.

SECOND EXAMPLE

The mixing step for forming a raw powder by mixing, the compacting step, and the melting and setting step for the resin were performed under the same conditions as those in the First Example. Then, the crystallizing step for the resin was performed while maintaining the sample at a heating temperature of 315° C. for the maintaining time shown in Table 2 in an air atmosphere, and samples having sample numbers 11 to 15 were formed. In these samples, the compressive strength, the rattler value, the iron loss and the magnetic flux density were measured under the same conditions as those in the First Example, and the results are shown in Table 2. In this case, the measurement results of the samples having sample number 01 (example in which the crystallizing step for the resin was not performed) and sample number 07 (example in which the heating and maintaining time was 120 minutes) in the First Example are also shown in Table 2.

TABLE 2

| | Crystallizing step for resin | | | Evaluation items | | | | |
|---|---|---|---|---|---|---|---|---|
| Sample No. | Heating temperature (° C.) | Maintaining time (min) | Atmosphere | Compressive strength (MPa) | Rattler value (%) | Iron loss $W_{0.245\ T/5\ kHz}$ (kW/m$^3$) | Magnetic flux density $B_{8000\ A/m}$ (T) | Notes |
| 01 | — | 0 | — | 476 | 0.53 | 3006 | 1.860 | Crystallizing step for the resin was not performed (conventional example) |
| 11 | 315 | 5 | Air | 531 | 0.48 | 3002 | 1.862 | Outside of preferable range |
| 12 | 315 | 10 | Air | 583 | 0.37 | 3000 | 1.862 | Lower limit of preferable range |
| 13 | 315 | 60 | Air | 600 | 0.29 | 2998 | 1.867 | |
| 07 | 315 | 120 | Air | 607 | 0.29 | 2980 | 1.865 | |

TABLE 2-continued

| Sample No. | Crystallizing step for resin: Heating temperature (° C.) | Crystallizing step for resin: Maintaining time (min) | Crystallizing step for resin: Atmosphere | Evaluation items: Compressive strength (MPa) | Evaluation items: Rattler value (%) | Evaluation items: Iron loss $W_{0.245\ T/5\ kHz}$ (kW/m$^3$) | Evaluation items: Magnetic flux density $B_{8000\ A/m}$ (T) | Notes |
|---|---|---|---|---|---|---|---|---|
| 14 | 315 | 180 | Air | 598 | 0.30 | 2984 | 1.865 | Upper limit of preferable range |
| 15 | 315 | 240 | Air | 576 | 0.30 | 2988 | 1.864 | Outside of preferable range |

In the sample (sample number 11) heated and maintained for 5 minutes in the crystallizing step for the resin, the compressive strength and the rattler value are improved, and the effects of the crystallizing step for the resin were obtained. In the samples heated and maintained for 10 minutes or more, the compressive strength and the rattler value were further improved, and the improving effects were high and were constant. In this case, when the maintaining time was more than 2 hours, the compressive strength was slightly decreased, and the compressive strength of the sample (sample number 15) maintained for more than 3 hours was smaller than that of the sample (sample number 12) maintained for 10 minutes. On the other hand, the magnetic properties were constant regardless of the heating and maintaining time, and the heating and maintaining time did not affect the magnetic properties. Thus, in the crystallizing step for the resin, the compressive strength and the rattler value could be improved by heating and maintaining the sample for 5 minutes, and the compressive strength and the rattler value were further improved when the heating and maintaining time was 10 minutes or more. Therefore, the heating and maintaining time is preferably set to 10 minutes or more. On the other hand, the magnetic properties of a sample were not effectively improved even when the sample was maintained for a long time, and the strength was decreased when the heating and maintaining was 3 hours or more. Moreover, in industrial production, the production cost may be increased if the treatment time is long. Therefore, the heating and maintaining time is preferably set to be not more than 3 hours.

THIRD EXAMPLE

The mixing step for forming a raw powder by mixing, the compacting step, and the melting and setting step for the resin were performed under the same conditions as those of the First Example. Then, the crystallizing step for the resin was performed at a heating temperature of 315° C. and a heating and maintaining time of 120 minutes so as to form a sample having sample number 16, while the atmosphere during heating was changed to a nitrogen gas atmosphere. In the sample, the compressive strength, the rattler value, the iron loss, and the magnetic flux density were measured under the same conditions as those in the First Example, and the results are shown in Table 3. In this case, the measurement results of the sample number 01 (example in which the crystallizing step for the resin was not performed) and the sample number 07 (example formed in an air atmosphere) in the First Example are also shown in Table 3.

TABLE 3

| Sample No. | Crystallizing step for resin: Heating temperature (° C.) | Crystallizing step for resin: Maintaining time (min) | Crystallizing step for resin: Atmosphere | Evaluation items: Compressive strength (MPa) | Evaluation items: Rattler value (%) | Evaluation items: Iron loss $W_{0.245\ T/5\ kHz}$ (kW/m$^3$) | Evaluation items: Magnetic flux density $B_{8000\ A/m}$ (T) | Notes |
|---|---|---|---|---|---|---|---|---|
| 01 | — | — | — | 476 | 0.53 | 3006 | 1.860 | Crystallizing step for the resin was not performed (conventional example) |
| 07 | 315 | 120 | Air | 607 | 0.29 | 2980 | 1.865 | Air atmosphere |
| 16 | 315 | 120 | Nitrogen gas | 521 | 0.35 | 2984 | 1.860 | Nitrogen gas atmosphere |

According to a comparison of the samples having sample numbers 01 and 16, the compressive strength and the rattler value were improved even when nitrogen gas, which was used during the heating in the melting and setting step for the resin, was also used during the heating in the crystallizing step for the resin. Moreover, according to a comparison of the samples having sample numbers 07 and 16, the compressive strength and the rattler value were improved when nitrogen gas was used during the heating in the crystallizing step for the resin, but the effect was smaller than that in a case in which an air atmosphere was used. This is because impurities which do not form crystals in thermoplastic resin are not removed in the nitrogen gas atmosphere, and they remain between crystals of the thermoplastic resin. Therefore, the strength and the binding power are decreased. On the other hand, in the air atmosphere, the impurities in the thermoplastic resin are removed by bonding with C or O contained in the air atmosphere, and the cause of decrease of the strength and the binding power is removed. As a result, the strength and the binding power are further improved compared to a case of using the nitrogen atmosphere. As described above, the strength and the binding power are improved when nitrogen gas is used during heating in the crystallizing step for the resin, and they are further improved when the air atmosphere is used.

FOURTH EXAMPLE

The thermoplastic polyimide powder (resin A) having a median size of 30 μm and a specific surface area of 2.0

$m^2/cm^3$, which was used in the First to the Third Examples, was prepared. Moreover, a thermoplastic polyimide powder (resin B) having a median size of 30 μm and a specific surface area of 0.3 $m^2/cm^3$, and a thermoplastic polyimide powder (resin C) having a median size of 50 μm and a specific surface area of 0.3 $m^2/cm^3$ were prepared. These thermoplastic resin powders were added at ratios shown in Table 4 to the electrically insulated iron powder used in the First Example, and they were mixed so as to obtain raw powders. The compacting step and the melting and setting step for the resin were performed under the same conditions as those in the First Example, and samples having sample numbers 17, 19, 21, and 23 were formed. Then, the crystallizing step for the resin was performed on these samples at a heating temperature of 305° C. and a heating and maintaining time of 120 minutes in an air atmosphere, and samples having sample numbers 18, 20, 22, and 24 were formed. In these samples (samples having sample numbers 17 to 24), the compressive strength, the rattler value, the iron loss, and the magnetic flux density were measured, and the results are shown in Table 4. In this case, the measurement results of samples having sample number 01 (example in which the crystallizing step for the resin was not performed) and sample number 07 (example in which the crystallizing step was performed) are also shown in Table 4.

TABLE 4

| | Thermoplastic resin | | | | | Evaluation items | | | | |
|---|---|---|---|---|---|---|---|---|---|---|
| Sample No. | Type of resin | Median size (μm) | Specific surface area ($m^2/cm^3$) | Additive amount (vol %) | Crystallizing step for resin | Compressive strength (MPa) | Rattler value (%) | Iron loss $W_{0.245\ T/5\ kHz}$ ($kW/m^3$) | Magnetic flux density $B_{8000\ A/m}$ (T) | Notes |
| 17 | A | 30 | 2.0 | 0.05 | unperformed | 430 | 0.80 | 3200 | 1.870 | |
| 18 | A | 30 | 2.0 | 0.05 | performed | 570 | 0.35 | 3185 | 1.873 | |
| 01 | A | 30 | 2.0 | 0.1 | unperformed | 476 | 0.53 | 3006 | 1.860 | |
| 07 | A | 30 | 2.0 | 0.1 | performed | 607 | 0.29 | 2980 | 1.865 | |
| 19 | B | 30 | 0.3 | 0.3 | unperformed | 520 | 0.50 | 3003 | 1.850 | |
| 20 | B | 30 | 0.3 | 0.3 | performed | 630 | 0.27 | 2980 | 1.850 | |
| 21 | C | 50 | 0.3 | 1.0 | unperformed | 510 | 0.40 | 3400 | 1.800 | |
| 22 | C | 50 | 0.3 | 1.0 | performed | 650 | 0.24 | 3300 | 1.792 | |
| 23 | C | 50 | 0.3 | 5.0 | unperformed | 520 | 0.35 | 3200 | 1.700 | |
| 24 | C | 50 | 0.3 | 5.0 | performed | 660 | 0.22 | 3100 | 1.703 | |

Each pair of the samples having sample numbers 17 and 18, the samples having sample numbers 19 and 20, the samples having sample numbers 21 and 22, and the samples having sample numbers 23 and 24, contained the same kind of thermoplastic resin and had the same additive amount, and each pair thereof had a different processing history regarding whether the crystallizing step was performed or was not performed. In each case of these samples in which the crystallizing step for the resin was performed, the compressive strength and the rattler value were more improved than those of the samples in which the crystallizing step for the resin was not performed. Moreover, the effect of the crystallizing step for the resin increased as the amount of the resin added decreased. This is because the amount of the resin existing between the soft magnetic powder particles is decreased as the additive amount of the resin in the soft magnetic powdered core decreases, whereby the improving effect for the strength and the binding power are efficiently obtained by crystallizing the thermoplastic resin.

FIFTH EXAMPLE

In the samples having sample numbers 01 and 07 in the First Example, the melting and setting step for the resin was performed by heating to 360° C. for 1 hour in a nitrogen gas atmosphere. The sample having sample number 07 is an example of the present invention in which the crystallizing step for the resin was performed by heating and maintaining at 315° C. for 120 minutes in an air atmosphere after the melting and setting step for a resin. The sample having sample number 01 is a conventional example in which the crystallizing step for the resin was not performed. On the other hand, a sample having sample number 25 was formed by a procedure in which the mixing step for forming a raw powder by mixing and the compacting step were performed under the same conditions as those in the First Example, and the crystallizing step for the resin was performed under the same conditions as the case of the sample having sample number 05 instead of performing the melting and the setting process for the resin. In this example, the compressive strength, the rattler value, the iron loss, and the magnetic flux density were measured. These samples were compared, and the results are shown in Table 5.

TABLE 5

| | | | Evaluation items | | | | |
|---|---|---|---|---|---|---|---|
| Sample No. | Melting and setting step for resin | Crystallizing step for resin | Compressive strength (MPa) | Rattler value (%) | Iron loss $W_{0.245\ T/5\ kHz}$ ($kW/m^3$) | Magnetic flux density $B_{8000\ A/m}$ (T) | Notes |
| 01 | performed | unperformed | 476 | 0.53 | 3006 | 1.860 | Crystallizing step for the resin was not performed (conventional example) |
| 07 | performed | performed | 607 | 0.29 | 2980 | 1.865 | Example of the present invention |

TABLE 5-continued

| Sample No. | Melting and setting step for resin | Crystallizing step for resin | Evaluation items: Compressive strength (MPa) | Rattler value (%) | Iron loss $W_{0.245\ T/5\ kHz}$ (kW/m$^3$) | Magnetic flux density $B_{8000\ A/m}$ (T) | Notes |
|---|---|---|---|---|---|---|---|
| 25 | unperformed | performed | 570 | 0.34 | 3001 | 1.860 | Example of the present invention |

In the sample having sample number 25, the compressive strength and the rattler value were inferior to those of the sample having sample number 07, but they were superior to those of the sample having sample number 01. Therefore, the strength and the binding power can be improved more by performing the crystallizing step for the resin without performing the melting and setting step for the resin than by only performing a conventional melting and setting step for the resin. In this case, the strength and the binding power are further improved by performing the melting and setting step for the resin before the crystallizing step for the resin. Accordingly, the melting and setting step for the resin may be performed in accordance with the circumstances.

In a soft magnetic powdered core obtained by the production method of the present invention, thermoplastic resin contained in the soft magnetic powdered core is completely crystallized so as to improve strength and binding power. The soft magnetic powdered core of the present invention is preferably used for electric transformers, reactors, thyristor valves, noise filters, choke coils, and the like, and is more preferably used for magnet cores of motors, rotors and yokes of motors in home appliances and industrial instruments, solenoid cores (stator cores) for solenoid valves installed in an electronically controlled fuel injector for a diesel engine or a gasoline engine, and the like, which require high magnetic flux density.

What is claimed is:

1. A method for producing a soft magnetic powdered core, comprising:

a mixing step for forming a raw powder by adding 0.005 to 1 vol. % of a thermoplastic resin powder having a median size of not more than 50 μm to a soft magnetic powder coated with an electrical insulating film on a surface thereof; the thermoplastic resin powder comprised of a thermoplastic resin; and mixing the thermoplastic resin powder and the soft magnetic powder together;

a compacting step for forming a compact by compacting the raw powder into a predetermined shape;

a melting and setting step for the thermoplastic resin in which the thermoplastic resin of the compact is melted by heating the compact in one of a nitrogen gas atmosphere and an inert gas atmosphere to at least a melting point of the thermoplastic resin; and setting the melted thermoplastic resin by cooling the melted thermoplastic resin to room temperature; and a recrystallizing step for the thermoplastic resin in which the set thermoplastic resin is heated in an air atmosphere to a temperature range not less than an exothermic onset temperature measured by differential scanning calorimetry (DSC) analysis of the thermoplastic resin and to a temperature range not more than an endothermic onset temperature measured by DSC analysis of the thermoplastic resin, and cooling the set resin to room temperature.

2. The method for producing a soft magnetic powdered core according to claim 1, wherein the recrystallizing step for the thermoplastic resin is performed in a temperature range of not less than an exothermic peak temperature measured by DSC analysis of the thermoplastic resin and not more than an exothermic end temperature measured by DSC analysis of the thermoplastic resin, or in a temperature range of ±10° C. of the exothermic peak temperature measured by DSC analysis of the thermoplastic resin.

3. A method for producing a soft magnetic powdered core, comprising:

a mixing step for forming a raw powder by adding 0.005 to 1 vol. % of a thermoplastic resin powder having a median size of not more than 50 μm to a soft magnetic powder coated with an electrical insulating film on a surface thereof; the thermoplastic resin powder comprised of a thermoplastic resin; and mixing the thermoplastic resin powder and the soft magnetic powder together;

a compacting step for forming a compact by compacting the raw powder into a predetermined shape; and a melting and setting step for the thermoplastic resin in which the thermoplastic resin of the compact is melted by heating the compact in one of a nitrogen gas atmosphere and an inert gas atmosphere to at least a melting point of the thermoplastic resin; and the compact is maintained in a temperature range of not more than an exothermic onset temperature measured by differential scanning calorimetry (DSC) analysis of the thermoplastic resin and not less than an exothermic end temperature measured by DSC analysis of the thermoplastic resin, and a set thermoplastic resin is cooled to room temperature in an air atmosphere.

4. A method for producing a soft magnetic powdered core, comprising:

a mixing step for forming a raw powder by adding 0.005 to 1 vol. % of a thermoplastic resin powder having a median size of not more than 50 μm to a soft magnetic powder coated with an electrical insulating film on a surface thereof; the thermoplastic resin powder comprised of a thermoplastic resin; and mixing the thermoplastic resin powder and the soft magnetic powder together;

a compacting step for forming a compact by compacting the raw powder into a predetermined shape; and a crystallizing step for the thermoplastic resin in which the compact is heated in an air atmosphere to a temperature range not less than an exothermic onset temperature measured by differential scanning calorimetry (DSC) analysis of the thermoplastic resin and not more than an endothermic onset temperature measured by DSC analysis of the thermoplastic resin, and is cooled to room temperature.

* * * * *

UNITED STATES PATENT AND TRADEMARK OFFICE

CERTIFICATE OF CORRECTION

PATENT NO. : 8,029,626 B2
APPLICATION NO. : 12/076336
DATED : October 4, 2011
INVENTOR(S) : Chio Ishihara et al.

It is certified that error appears in the above-identified patent and that said Letters Patent is hereby corrected as shown below:

Title page item [73]
Please change Assignee name "Hitachi Powered Metals Co., Ltd." to "Hitachi Powdered Metals Co., Ltd."

Signed and Sealed this
Twenty-ninth Day of November, 2011

David J. Kappos

David J. Kappos
*Director of the United States Patent and Trademark Office*